US008957837B2

(12) United States Patent
Han

(10) Patent No.: US 8,957,837 B2
(45) Date of Patent: Feb. 17, 2015

(54) PIXEL AND ORGANIC LIGHT EMITTING DISPLAY USING THE SAME

(75) Inventor: Sam-Il Han, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 565 days.

(21) Appl. No.: 13/032,139

(22) Filed: Feb. 22, 2011

(65) Prior Publication Data

US 2012/0013597 A1 Jan. 19, 2012

(30) Foreign Application Priority Data

Jul. 19, 2010 (KR) ..... 10-2010-0069505

(51) Int. Cl.
*G09G 3/30* (2006.01)
*G09G 3/32* (2006.01)

(52) U.S. Cl.
CPC ..... *G09G 3/3233* (2013.01); *G09G 3/3291* (2013.01); *G09G 2300/0819* (2013.01); *G09G 2300/0861* (2013.01); *G09G 2320/0209* (2013.01); *G09G 2320/0238* (2013.01); *G09G 2320/0252* (2013.01); *G09G 2300/0852* (2013.01)
USPC ..... 345/78; 345/76; 345/77

(58) Field of Classification Search
USPC ..... 345/76–83
See application file for complete search history.

(56) References Cited

U.S. PATENT DOCUMENTS

2003/0214466 A1 11/2003 Kimura
2005/0200300 A1* 9/2005 Yumoto ..... 315/169.1
2005/0200575 A1 9/2005 Kim et al.
2006/0055336 A1* 3/2006 Jeong ..... 315/169.3
2006/0176251 A1 8/2006 Park et al.
2006/0220580 A1 10/2006 Omata et al.
2008/0036710 A1* 2/2008 Kim ..... 345/82
2008/0218497 A1 9/2008 Takahashi
2009/0051628 A1* 2/2009 Kwon ..... 345/77
2009/0108763 A1 4/2009 Han et al.
2009/0174699 A1 7/2009 Fish et al.
2009/0225013 A1 9/2009 Lee et al.
2010/0013816 A1* 1/2010 Kwak ..... 345/211
2010/0053233 A1 3/2010 Ishiguro et al.
2011/0042692 A1 2/2011 Matsueda

FOREIGN PATENT DOCUMENTS

CN 1819000 A 8/2006
JP 2004-46127 2/2004
JP 2006-078911 3/2006

(Continued)

OTHER PUBLICATIONS

Korea Patent Abstracts Publication No. KR 1020040072215 A dated Aug. 18, 2004, for corresponding Korean Patent KR 10-0496884 listed above.
Korean Patent Abstracts Publication No. KR1020090042006 A dated Apr. 29, 2009, for corresponding Korean Patent KR 10-0897172 listed above.

(Continued)

*Primary Examiner* — Andrew Sasinowski
*Assistant Examiner* — Nguyen H Truong
(74) *Attorney, Agent, or Firm* — Christie, Parker & Hale, LLP

(57) ABSTRACT

A pixel is capable of securing enough threshold voltage compensating time in high resolution and high frequency driving and of compensating for the IR drop of a first power source ELVDD, and an organic light emitting display includes the pixel.

9 Claims, 4 Drawing Sheets

(56) References Cited

FOREIGN PATENT DOCUMENTS

| | | | |
|---|---|---|---|
| JP | 2006-284942 | | 10/2006 |
| JP | 2009-222838 | | 10/2009 |
| JP | 2010-78947 | | 4/2010 |
| JP | 2010-091608 | | 4/2010 |
| KR | 10-0496884 | | 6/2005 |
| KR | 10-2006-0023672 | A | 3/2006 |
| KR | 10-2006-0064194 | A | 6/2006 |
| KR | 10-2006-0112983 | A | 11/2006 |
| KR | 10-0795810 | B1 | 1/2008 |
| KR | 10-2008-0082464 | | 9/2008 |
| KR | 10-0897172 | | 5/2009 |
| WO | WO 03/044762 | A | 5/2003 |

OTHER PUBLICATIONS

Korean Office action dated Jun. 21, 2012 for Korean Application No. 10-2010-0069505, 1 page.

European Patent Office, Extended European Search Report for Application No. EP 11171130.5, dated Jul. 16, 2012, 6 pgs.

KIPO Office action dated Nov. 23, 2011, for Korean priority Patent application 10-2010-0069505, 5 pages.

JPO Office action dated Aug. 5, 2014, for corresponding Japanese Patent application 2010-254102, (2 pages).

SIPO Office action dated Aug. 29, 2014, for corresponding Chinese Patent application 201010623033.3, (10 pages).

* cited by examiner

PIXEL AND ORGANIC LIGHT EMITTING DISPLAY USING THE SAME

CROSS-REFERENCE TO RELATED APPLICATION

This application claims priority to and the benefit of Korean Patent Application No. 10-2010-0069505, filed on Jul. 19, 2010, in the Korean Intellectual Property Office, the entire content of which is incorporated herein by reference.

BACKGROUND

1. Field

Aspects of the present invention relate to an organic light emitting display and to a pixel of an organic light emitting display.

2. Description of the Related Art

Recently, various flat panel displays (FPDs) with reduced weight and volume in comparison to cathode ray tube (CRT) have been developed. The FPDs include liquid crystal displays (LCDs), field emission displays (FEDs), plasma display panels (PDPs), and organic light emitting displays.

Among the FPDs, the organic light emitting displays display images using organic light emitting diodes (OLEDs) that generate light by re-combination of electrons and holes. The organic light emitting display has fast response speed and is driven with low power consumption.

FIG. 1 is a circuit diagram illustrating a pixel of an organic light emitting display of the related art.

Referring to FIG. 1, a pixel 4 of the organic light emitting display includes an organic light emitting diode OLED and a pixel circuit 2 coupled to a data line Dm and a scan line Sn to control the OLED.

The anode electrode of the OLED is coupled to the pixel circuit 2, and the cathode electrode of the OLED is coupled to a second power source ELVSS. The OLED emits light with brightness corresponding to the current supplied from the pixel circuit 2.

The pixel circuit 2 controls the amount of current supplied to the OLED to correspond to a data signal supplied to the data line Dm when a scan signal is supplied to the scan line Sn. Here, the pixel circuit 2 includes a second transistor M2 coupled between a first power source ELVDD and the OLED, a first transistor M1 coupled to the second transistor T2, the data line Dm, and the scan line Sn, and a storage capacitor Cst coupled between the gate electrode and the first electrode of the second transistor T2.

The gate electrode of the first transistor T1 for performing operations as a switching element is coupled to the scan line Sn, and the first electrode of the first transistor T1 is coupled to the data line Dm. The second electrode of the first transistor T1 is coupled to one terminal of the storage capacitor Cst. Here, the first electrode is set as one of a source electrode and a drain electrode, and the second electrode is set as an electrode different from the first electrode. For example, when the first electrode is the source electrode, the second electrode is the drain electrode.

The first transistor T1 coupled to the scan line Sn and the data line Dm is turned on when the scan signal is supplied from the scan line Sn to supply the data signal supplied from the data line Dm to the storage capacitor Cst. At this time, the storage capacitor Cst stores the voltage corresponding to the data signal.

The gate electrode of the second transistor T2 for performing an operation as a driving element is coupled to one end of the storage capacitor Cst, and the first electrode of the second transistor T2 is coupled to the other terminal of the storage capacitor Cst and the first power source ELVDD. The second electrode of the second transistor T2 is coupled to the anode electrode of the OLED. The second transistor T2 controls the amount of current that flows from the first power source ELVDD to the second power source ELVSS via the OLED to correspond to the value of the voltage stored in the storage capacitor Cst. At this time, the OLED emits light corresponding to the amount of current supplied from the second transistor M2.

In the above-described pixel structure of the related art, the threshold voltage and electron mobility of the second transistor T2 as the driving element vary with each of the pixels 4 due to process deviation. Deviation in the threshold voltage and electron mobility of the second transistor T2 causes the pixels 4 to emit light with different gray levels with respect to the same gray level voltage, hence an image with uniform brightness cannot be displayed.

In order to solve the above problem, various pixel circuits for compensating for the threshold voltage of the second transistor T2 are suggested.

In addition, recently, in order to realize a FPD with high picture quality and high resolution, high frequency driving (for example, 120 Hz) tends to be performed. However, in this case, scan time, e.g., one horizontal period (1H), is reduced in comparison with conventional frequency driving (for example, 60 Hz). As the one horizontal period (1H) is reduced, the threshold voltage compensating time of the second transistor that is the driving element is reduced.

That is, in the related art, in the high resolution and high frequency driving that is the tendency of the FPD, sufficient threshold voltage compensation time may not be secured so that picture quality deteriorates.

SUMMARY

Aspects of embodiments according to the present invention are directed toward a pixel capable of securing enough threshold voltage compensating time and of compensating for the IR drop of a first power source ELVDD in high resolution and high frequency driving and an organic light emitting display using the same.

According to an embodiment of the present invention, there is provided a pixel including an organic light emitting diode (OLED), a first transistor for controlling an amount of current supplied from a first power source coupled to a first electrode of the first transistor to the OLED, a first capacitor coupled between the first power source and a first node coupled to a gate electrode of the first transistor, a second capacitor having a first electrode coupled to the first node, a second transistor coupled between a second node and a data line and having a gate electrode coupled to a first scan line, the second node being coupled to a second electrode of the second capacitor, a third transistor coupled between a gate electrode and a second electrode of the first transistor and having a gate electrode coupled to a second scan line, a fourth transistor coupled between the second electrode of the second capacitor and a reference power source and having a gate electrode coupled to the second scan line, a fifth transistor coupled between the gate electrode of the first transistor and an initial power source and having a gate electrode coupled to a third scan line, and a sixth transistor coupled between the second electrode of the first transistor and an anode electrode of the OLED and having a gate electrode coupled to an emission control line.

The second transistor may include a pair of second transistors serially coupled to each other, and the sixth transistor may include a pair of sixth transistors serially coupled to each other. A node between the pair of second transistors and a node between the pair of sixth transistors are electrically coupled to each other.

Scan signals applied to the first to third scan lines may be sequentially applied so as not to overlap each other. The scan signals applied to the first to third scan lines may be applied in a period no less than one horizontal period 1H.

The reference power source may be configured to supply a DC voltage having a fixed voltage value. The initial power source may be configured to supply a voltage lower than the first power source. The reference power source and the initial power source may be configured to have the same voltage value.

According to an embodiment of the present invention, there is provided an organic light emitting display including a scan driver for supplying first to third scan signals to first to third scan lines and for supplying emission control signals to emission control lines, a data driver for supplying data signals to data lines, a pixel unit including pixels coupled to the first to third scan lines, the emission control lines, and the data lines. Each of the pixels includes an organic light emitting diode (OLED), a first transistor for controlling an amount of current supplied from a first power source coupled to a first electrode of the first transistor to the OLED, a first capacitor coupled between the first power source and a first node coupled to a gate electrode of the first transistor, a second capacitor having a first electrode coupled to the first node, a second transistor coupled between a second node and a data line and having a gate electrode coupled to the first scan line, the second node being coupled to a second electrode of the second capacitor, a third transistor coupled between the gate electrode and a second electrode of the first transistor and having a gate electrode coupled to the second scan line, a fourth transistor coupled between the second electrode of the second capacitor and a reference power source and having a gate electrode coupled to the second scan line, a fifth transistor coupled between the gate electrode of the first transistor and an initial power source and having a gate electrode coupled to the third scan line, and a sixth transistor coupled between the second electrode of the first transistor and an anode electrode of the OLED and having a gate electrode coupled to the emission control line.

As described above, according to the embodiments of the present invention, the threshold voltage of the driving transistor may be compensated for in a period no less than 1H and an image with desired brightness may be displayed regardless of the IR drop of the first power source ELVDD.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
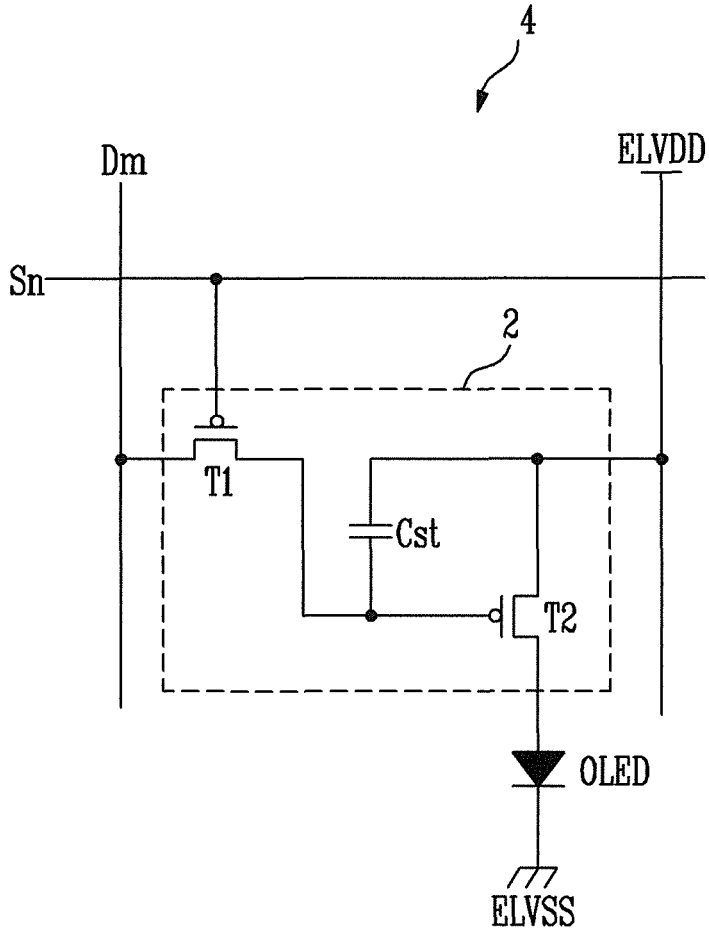
FIG. 1 is a circuit diagram illustrating a pixel of an organic light emitting display according to the related art.

Hereinafter, certain exemplary embodiments according to the present invention will be described with reference to the accompanying drawings. Here, when a first element is described as being coupled to a second element, the first element may be directly coupled to the second element, or may be indirectly coupled to the second element via one or more third elements. Further, some of the elements that are not essential to a complete understanding of the invention are omitted for clarity. Also, like reference numerals refer to like elements throughout.

Hereinafter, exemplary embodiments of the present invention will be described in detail with reference to the accompanying drawings.

Figure 2:
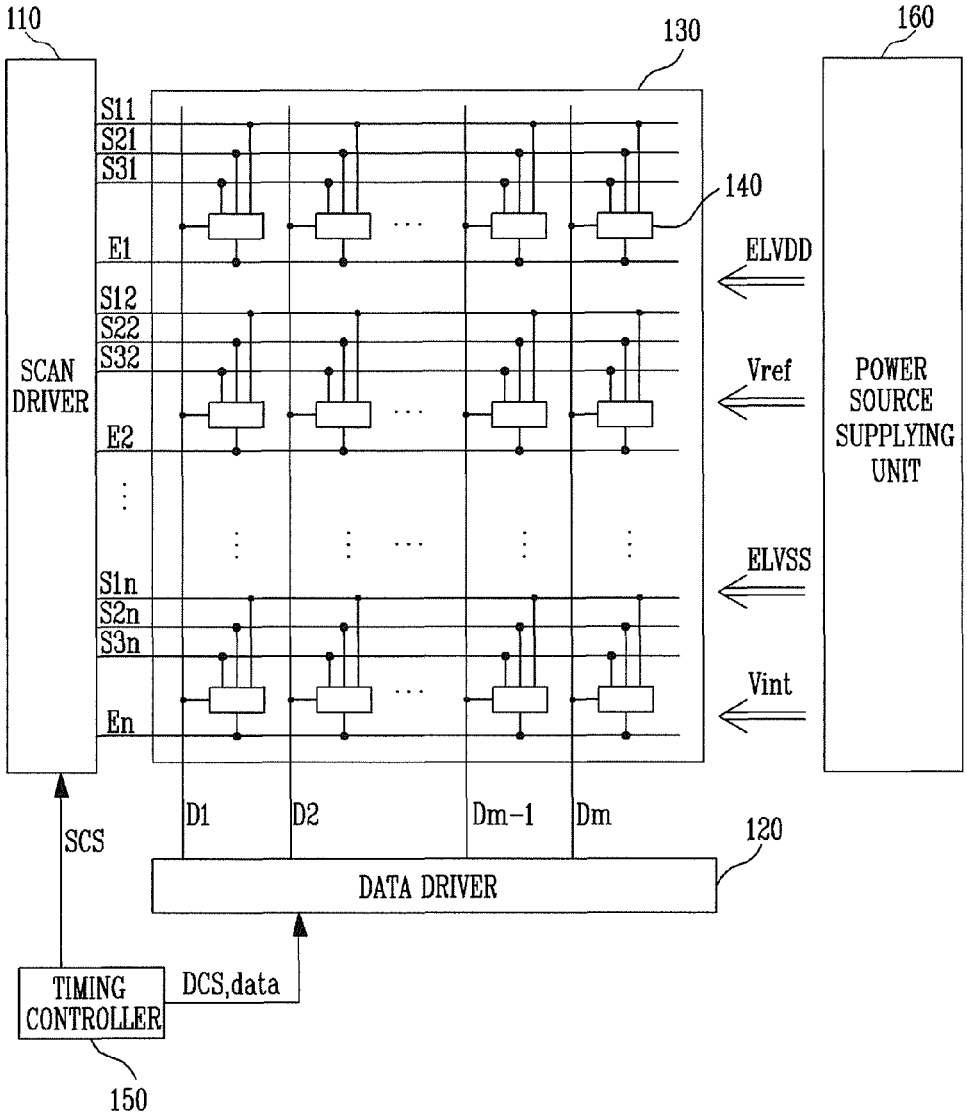
FIG. 2 is a block diagram illustrating an organic light emitting display according to an embodiment of the present invention.

FIG. 2 is a block diagram illustrating an organic light emitting display according to an embodiment of the present invention.

Referring to FIG. 2, the organic light emitting display according to an embodiment of the present invention includes a pixel unit 130 including: a plurality of pixels 140 coupled to first scan lines S11 to S1n, second scan lines S21 to S2n, third scan lines S31 to S3n, emission control lines E1 to En, and data lines D1 to Dm; a scan driver 110 for driving the first to third scan lines S11 to S1n, S21 to S2n, and S31 to S3n and the emission control lines E1 to En; a data driver 120 for driving the data lines D1 to Dm; and a timing controller 150 for controlling the scan driver 110 and the data driver 120.

The pixel unit 130 includes the plurality of pixels 140 coupled to the first to third scan lines S11 to S1n, S21 to S2n, and S31 to S3n, the emission control lines E1 to En, and the data lines D1 to Dm. The pixels 140 receive power from a first power source ELVDD, a second power source ELVSS, a reference power source Vref, and an initial power source Vint from a power source supply unit 160. The pixels 140 generate light with predetermined brightness while controlling the amount of current supplied from the first power source ELVDD to the second power source ELVSS via organic light emitting diodes (OLEDs) to correspond to data signals.

The timing controller 150 generates data driving control signals DCS and scan driving control signals SCS to correspond to the synchronization signals supplied from the outside. The data driving control signals DCS generated by the timing controller 150 are supplied to the data driver 120 and the scan driving control signals SCS are supplied to the scan driver 110. The timing controller 150 supplies data Data supplied from the outside to the data driver 120.

The scan driver 110 receives the scan driving control signals SCS. In response to receiving the scan driving control signals SCS, the scan driver 110 supplies scan signals (for example, low voltage signals) to the first to third scan lines S11 to S1n, S21 to S2n, and S31 to S3n. The scan driver 110 supplies emission control signals to the emission control lines E1 to En.

According to an embodiment of the present invention, the scan signals supplied to the first to third scan lines S11 to S1n, S21 to S2n, and S31 to S3n may be supplied for a time period longer than one horizontal period (1H), for example, 3H.

The data driver 120 receives the data driving control signals DCS from the timing controller 150. In response to receiving the data driving control signals DCS, the data driver 120 generates data signals and supplies the generated data signals to the data lines D1 to Dm.

Figure 3:
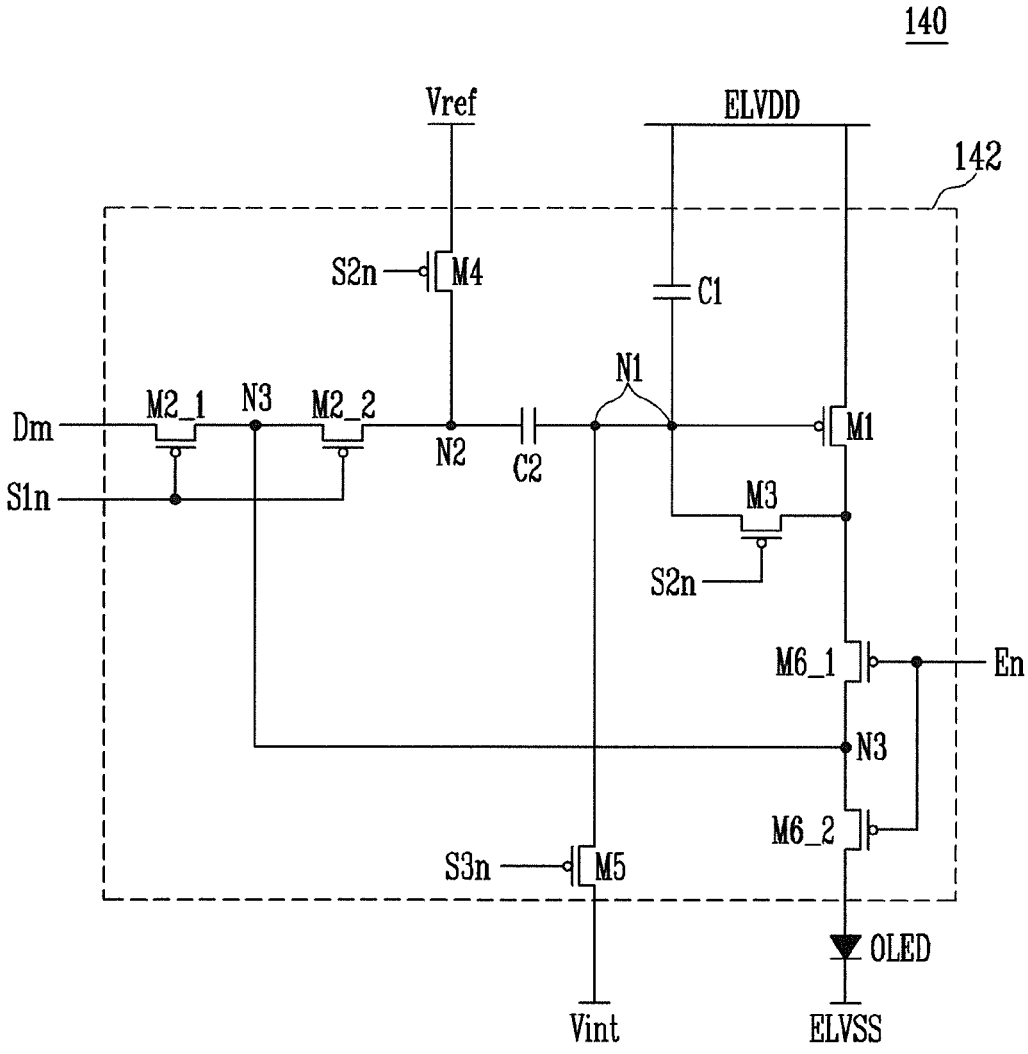
FIG. 3 is a circuit diagram illustrating a pixel according to an embodiment of the present invention.

FIG. 3 is a circuit diagram illustrating a pixel according to an embodiment of the present invention.

For convenience sake, a pixel coupled to the 1n-th to 3n-th scan lines S1n, S2n, and S3n, the n-th emission control line En, and the m-th data line Dm will be described as an example.

Referring to FIG. 3, the pixel 140 according to an embodiment of the present invention includes an organic light emitting diode (OLED) and a pixel circuit 142 for controlling the amount of current supplied to the OLED.

The anode electrode of the OLED is coupled to the pixel circuit 142, and the cathode electrode of the OLED is coupled to the second power source ELVSS. The OLED generates light with predetermined brightness to correspond to the amount of current supplied from the pixel circuit 142.

The pixel circuit 142 controls the amount of current supplied to the OLED. The pixel circuit 142 includes a first transistor M1, second transistors M2_1 and M2_2, a third transistor M3, a fourth transistor M4, a fifth transistor M5, and sixth transistors M6_1 and M6_2.

According to the embodiment as illustrated in FIG. 3, the second transistors M2_1 and M2_2 and the sixth transistors M6_1 and M6_2 are realized so that a pair of transistors are serially coupled to each other, respectively. A node N3 between the transistors M2_1 and M2_2 and another node N3 between the transistors M6_1 and M6_2 are electrically coupled to each other.

The first transistor M1 functions as a driving transistor. The first electrode of the first transistor M1 is coupled to the first power source ELVDD, and the second electrode of the first transistor M1 is coupled to the first electrode of the transistor M6_1. The gate electrode of the first transistor M1 is coupled to a first node N1. The first transistor M1 controls the amount of current supplied to the OLED to correspond to the voltage applied to the first node N1.

The second transistors M2_1 and M2_2 are serially coupled between the data line Dm and a second node N2. The gate electrodes of the second transistors M2_1 and M2_2 are coupled to the first scan line S1n, and the second transistors M2_1 and M2_2 are turned on when a scan signal is supplied to the first scan line S1n to electrically couple the data line Dm and the second node N2 to each other.

The first electrode of the third transistor M3 is coupled to the second electrode of the first transistor M1, and the second electrode of the third transistor M3 is coupled to the first node N1. The gate electrode of the third transistor M3 is coupled to the second scan line S2n. The third transistor M3 is turned on when a scan signal is supplied to the second scan line S2n to electrically couple the second electrode of the first transistor M1 and the first node N1 to each other. In this case, the first transistor M1 is coupled in the form of a diode.

The first electrode of the fourth transistor M4 is coupled to a reference power source Vref, and the second electrode of the fourth transistor M4 is coupled to the second node N2. The gate electrode of the fourth transistor M4 is coupled to the second scan line S2n. The fourth transistor M4 is turned on when the scan signal is supplied to the second scan line S2n to supply the voltage of the reference power source Vref to the second node N2.

The reference power source Vref supplies a DC voltage having a fixed value. The reference power source Vref may be an additional power source or may be provided as a voltage having the same level as an initial power source Vint.

The first electrode of the fifth transistor M5 is coupled to the first node N1, and the second electrode of the fifth transistor M5 is coupled to the initial power source Vint. The gate electrode of the fifth transistor M5 is coupled to the third scan line S3n. The fifth transistor M5 is turned on when a scan signal is supplied to the third scan line S3n to supply the voltage of the initial power source Vint to the first node N1. The initial power source Vint having a voltage value at a low level may be set as a voltage lower than the first power source ELVDD, for example, a voltage (for example, a ground voltage GND) lower than the threshold voltage of the OLED.

As illustrated in FIG. 3, the sixth transistors M6_1 and M6_2 are serially coupled to each other. The first electrode of the transistor M6_1 is coupled to the second electrode of the first transistor M1. The second electrode of the transistor M6_2 is coupled to the anode electrode of the OLED.

Since the transistor M6_1 and transistor M6_2 are serially coupled to each other, the second electrode of the transistor M6_1 is coupled to the first electrode of the transistor M6_2.

In addition, the gate electrodes of the sixth transistors M6_1 and M6_2 are coupled to the emission control line En. The sixth transistors M6_1 and 6M_2 are turned off when the emission control signal is supplied to the emission control line En and are turned on in the other cases.

A first capacitor C1 is coupled between the first node N1 and the first power source ELVDD. The first capacitor C1 stores the voltage corresponding to the threshold voltage of the first transistor M1.

A second capacitor C2 is coupled between the first node N1 and the second node N2. The second capacitor C2 stores the voltage corresponding to a data signal. The second capacitor C2 controls the voltage of the first node N1 to correspond to the amount of change of the voltage at the second node N2.

In addition, according to the embodiment of the present invention, as described above, the node N3 between the transistors M2_1 and M2_2 and the node N3 between the transistors M6_1 and M6_2 are coupled to each other.

The nodes N3 are coupled to each other in order to solve the problem of deterioration in picture quality caused by cross-talk generated by a pixel structure according to the related art.

In detail, in the related art, in order to solve the problem of the cross-talk generated by off leakages in accordance with the source-drain voltages Vds of the second transistor coupled to the second capacitor C2 being different, according to the embodiment of the present invention, as illustrated in FIG. 3, the voltage applied across the ends of the OLED in a period when the OLED emits light is biased by a fixed voltage value.

That is, the third node N3 between the sixth transistors M6_1 and M6_2 is electrically coupled to the third node N3 between the second transistors M2_1 and M2_2 so that the third node N3 has a fixed voltage value not being in a floating state in the period when the OLED emits light.

Therefore, when the sixth transistors M6_1 and M6_2 are turned on, the anode of the OLED is coupled to the third node N3 having the fixed voltage value so that it can solve the problem of the cross-talk generated by the off leakages of the source-drain voltage values Vds of the second transistor being different from each other in accordance with a change in the data voltage value applied to a data line.

Figure 4:
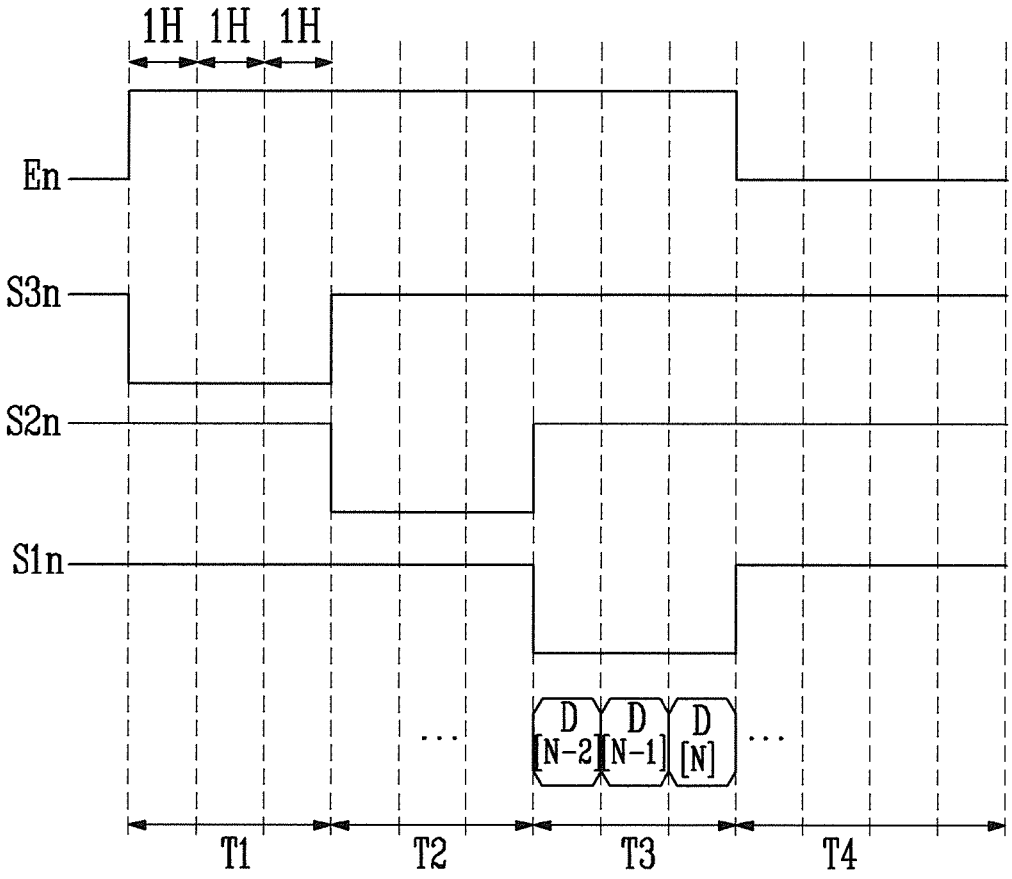
FIG. 4 is a timing diagram illustrating a method of driving the pixel of FIG. 3.

FIG. 4 is a timing diagram illustrating a method of driving the pixel of FIG. 3. In FIG. 4, for convenience sake, it is assumed that scan signals are supplied for a time period of 3H. However, the time period for which the scan signals are supplied is not limited to the time period of 3H. For example, the scan signals may be supplied for a time period no less than 1H.

When the pixel is driven at a high frequency (e.g., 120 Hz or 240 Hz) or the pixel is that of a display with high resolution (FHD or UD), the absolute time of 1H is reduced, in order to compensate for the reduced time, and the pulse width of the scan signals is increased to no less than 2H to secure compensation time.

Referring to FIG. 4, a scan signal is supplied to the third scan line S3n for a first period T1.

When the scan signal is supplied to the third scan line S3n, the fifth transistor M5 is turned on and the voltage of the initial power source Vint is supplied to the first node N1.

Here, the initial power source Vint having a voltage value at a low level may be set as a voltage lower than the first power source ELVDD, for example, a voltage (for example, a ground power source GND) lower than the threshold voltage of the OLED. As the initial power source Vint is applied to the first node N1, the first node N1 coupled to the gate electrode of the driving transistor M1 is initialized to the value of the initial power source Vint.

In addition, in the first period T1, since a high level signal is applied to the emission control line En, the sixth transistors M6_1 and M6_2 are turned off so that electrical coupling between the first transistor M1 and the OLED is blocked. At this time, the OLED is set to be in a non-emission state.

Therefore, according to the embodiment of the present invention, while the first node N1 is initialized, current does not flow to the OLED so that leakage current that may flow to the OLED during black brightness emission is removed and that a high contrast ratio (CR) may be secured.

Then, the scan signal is supplied to the second scan line S2n in a second period T2.

When the scan signal is supplied to the second scan line S2n, the fourth transistor M4 and the third transistor M3 are turned on. As the fourth transistor M4 is turned on, the voltage of the reference power source Vref is supplied to the second node N2.

The reference power source Vref supplies the DC voltage having a fixed value as described above. The reference power source Vref may be an additional power source or may be provided as the voltage of the same level as the initial power source Vint.

In addition, as the third transistor M3 is turned on, the first transistor M1 is coupled in the form of a diode.

At this time, when the first transistor M1 is coupled in the form of a diode, the voltage ELVDD-Vth obtained by subtracting the threshold voltage Vth of the first transistor M1 from the voltage of the first power source ELVDD is applied to the first node N1. For convenience sake, in one embodiment, it is assumed that the initial power source Vint is the ground voltage GND.

At this time, the first capacitor C1 stores the voltage corresponding to the threshold voltage Vth of the first transistor M1. On the other hand, according to an embodiment of the present invention, since the second period T2 is set as the period of 3H, which is a sufficiently long time, the voltage ELVDD-Vth obtained by subtracting the threshold voltage of the first transistor M1 from the first power source ELVDD is applied to the first node N1 so that sufficient threshold voltage compensating time may be secured.

In addition, since a high level signal is applied to the emission control line En in the second period T2, the sixth transistors M6_1 and M6_2 are turned off so that electrical coupling between the first transistor M1 and the OLED is blocked. At this time, the OLED is set in a non-emission state.

Then, in the third period T3, the scan signal is supplied to the first scan line S1n so that the second transistors M2_1 and M2_2 are turned on.

When the second transistors M2_1 and M2_2 are turned on, the data line Dm and the second node N2 are electrically coupled to each other. When the data line Dm and the second node N2 are electrically coupled to each other, a data signal from the data line Dm is supplied to the second node N2. Since the second transistors M2_1 and M2_2 are turned on in the period of 3H, the data signals corresponding to a (n-2)th horizontal line, a (n-1)th horizontal line, and a n-th horizontal line are sequentially supplied. Finally, the data signal corresponding to the n-th horizontal line is applied so that the voltage Vdata of a desired data signal is applied to the second node N2.

As the voltage of a desired data signal is applied to the second node N2, the voltage of the first node N1 increases by a difference Vdata-Vref between the voltage Vdata of the data signal and the reference power source Vref by the coupling operation of the second capacitor C2.

Since the first capacitor C1 and the second capacitor C2 are electrically coupled to each other, the value of the voltage transmitted to the first node N1 becomes $$\frac{C1}{C1+C2}(Vdata-Vref).$$

For example, when the initial power source Vint is applied to the ground voltage GND, the voltage of the first node N1 becomes $$ELVDD-Vth+\frac{C1}{C1+C2}(Vdata-Vref).$$

In addition, since the high level signal is applied to the emission control line En in the third period T3, the sixth transistors M6_1 and M6_2 are turned off so that electrical coupling between the first transistor M1 and the OLED is blocked. At this time, the OLED is set to be in a non-emission state.

Finally, since a low level signal is applied to the emission control line En in the fourth period T4, the sixth transistors M6_1 and M6_2 are turned on and the amount of current supplied to the OLED is controlled to correspond to the voltage stored in the first capacitor C1 by turning on the sixth transistors M6_1 and M6_2, that is, the Vgs value of the first transistor M1, that is, the voltage value $$Vth-\frac{C1}{C1+C2}(Vdata-Vref)$$

corresponding to a difference $$ELVDD-Vth+\frac{C1}{C1+C2}(Vdata-Vref)$$

between the first power source ELVDD that is a voltage applied to a source and the voltage applied to the first node N1.

At this time, the current Ids that flows to the OLED is represented by the following EQUATION.

$$Ids=\beta(Vgs-Vth)^2=\beta\left(Vth-\frac{C1}{C1+C2}(Vdata-Vref)-Vth\right)^2=\beta\left(\frac{C1}{C1+C2}(Vdata-Vref)\right)^2,\ \beta\text{: constant}$$

According to the embodiments of the present invention, since the amount of the current Ids that flows to the OLED is regardless of the threshold voltage Vth of the first transistor M1 and the first power source ELVDD, the problem of the IR drop of the first power source ELVDD may be solved.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A pixel comprising:

an organic light emitting diode (OLED);

a first transistor for controlling an amount of current supplied from a first power source coupled to a first electrode of the first transistor to the OLED;

a first capacitor coupled between the first power source and a first node coupled to a gate electrode of the first transistor;

a second capacitor having a first electrode coupled to the first node;

a second transistor coupled between a second node and a data line and having a gate electrode coupled to a first scan line, the second node being coupled to a second electrode of the second capacitor;

a third transistor coupled between a gate electrode and a second electrode of the first transistor and having a gate electrode coupled to a second scan line;

a fourth transistor coupled between the second electrode of the second capacitor and a reference power source and having a gate electrode coupled to the second scan line;

a fifth transistor coupled between the gate electrode of the first transistor and an initial power source and having a gate electrode coupled to a third scan line; and a sixth transistor coupled between the second electrode of the first transistor and an anode electrode of the OLED and having a gate electrode coupled to an emission control line, wherein the pixel shares each of the first to third scan lines only with other pixels in a same pixel row, wherein a voltage increase at the third scan line is simultaneous to and overlaps with a voltage decrease at the second scan line, wherein a voltage increase at the second scan line is simultaneous to and overlaps with a voltage decrease at the first scan line, wherein the second transistor comprises a pair of second transistors serially coupled to each other, and the sixth transistor comprises a pair of sixth transistors serially coupled to each other, and wherein a node between the pair of second transistors and a node between the sixth transistors are directly electrically coupled to each other.

2. The pixel as claimed in claim 1, wherein scan signals applied to the first to third scan lines are sequentially applied so as not to overlap each other.

3. The pixel as claimed in claim 2, wherein the scan signals applied to the first to third scan lines are applied in a period no less than one horizontal period 1H.

4. The pixel as claimed in claim 1, wherein the reference power source is configured to supply a DC voltage having a fixed voltage value.

5. The pixel as claimed in claim 1, wherein the initial power source is configured to supply a voltage lower than the first power source.

6. The pixel as claimed in claim 1, wherein the reference power source and the initial power source are configured to have the same voltage value.

7. An organic light emitting display comprising:

a scan driver for supplying first to third scan signals to first to third scan lines and for supplying emission control signals to emission control lines;

a data driver for supplying data signals to data lines;

a pixel unit comprising pixels coupled to the first to third scan lines, the emission control lines, and the data lines, wherein each of the pixels comprises:

an organic light emitting diode (OLED);

a first transistor for controlling an amount of current supplied from a first power source coupled to a first electrode of the first transistor to the OLED;

a first capacitor coupled between the first power source and a first node coupled to a gate electrode of the first transistor;

a second capacitor having a first electrode coupled to the first node;

a second transistor coupled between a second node and a data line and having a gate electrode coupled to the first scan line, the second node being coupled to a second electrode of the second capacitor;

a third transistor coupled between the gate electrode and a second electrode of the first transistor and having a gate electrode coupled to the second scan line;

a fourth transistor coupled between the second electrode of the second capacitor and a reference power source and having a gate electrode coupled to the second scan line;

a fifth transistor coupled between the gate electrode of the first transistor and an initial power source and having a gate electrode coupled to the third scan line; and a sixth transistor coupled between the second electrode of the first transistor and an anode electrode of the OLED and having a gate electrode coupled to the emission control line, wherein the pixel shares each of the first to third scan lines only with other pixels in a same pixel row, wherein a voltage increase at the third scan line is simultaneous to and overlaps with a voltage decrease at the second scan line, wherein a voltage increase at the second scan line is simultaneous to and overlaps with a voltage decrease at the first scan line, wherein the second transistor comprises a pair of second transistors serially coupled to each other, and the sixth transistor comprises a pair of sixth transistors serially coupled to each other, and wherein a node between the pair of second transistors and a node between the sixth transistors are directly electrically coupled to each other.

8. The organic light emitting display as claimed in claim 7, wherein the scan signals applied to the first to third scan lines are sequentially applied so as not to overlap each other.

9. The organic light emitting display as claimed in claim 8, wherein the scan signals applied to the first to third scan lines are applied for a period no less than one horizontal period (1H).

* * * * *